US006195908B1

(12) United States Patent
Crul

(10) Patent No.: US 6,195,908 B1
(45) Date of Patent: Mar. 6, 2001

(54) METHOD AND DEVICE FOR THERMAL DRYING OF A SOLID PRODUCT IN SMALL PIECES

(75) Inventor: Guido Crul, Diksmuide (BE)

(73) Assignee: D.S.P. N.V. (BE)

( * ) Notice: Subject to any disclaimer, the term of this patent is extended or adjusted under 35 U.S.C. 154(b) by 0 days.

(21) Appl. No.: 09/284,486

(22) PCT Filed: Oct. 23, 1997

(86) PCT No.: PCT/BE97/00123

§ 371 Date: Apr. 23, 1999

§ 102(e) Date: Apr. 23, 1999

(87) PCT Pub. No.: WO98/17956

PCT Pub. Date: Apr. 30, 1998

(30) Foreign Application Priority Data

Oct. 24, 1996 (BE) ..... 09600902

(51) Int. Cl.[7] ..... F26B 3/00

(52) U.S. Cl. ..... 34/343; 34/345; 34/355; 34/401; 34/71; 34/95; 34/217; 34/236; 426/640; 426/468; 426/518; 426/520

(58) Field of Search ..... 34/343, 345, 355, 34/397, 401, 435, 62, 71, 92, 95, 210, 217, 218, 236; 426/615, 640, 465, 468, 518, 520, 524; 99/443 C, 349, 353

(56) References Cited

U.S. PATENT DOCUMENTS 2,207,278 * 7/1940 Albrecht .
2,230,197 * 1/1941 Currie .
4,464,844 * 8/1984 Dickey et al. .
4,464,847 * 8/1984 Dickey et al. .

* cited by examiner

*Primary Examiner*—Pamela Wilson
(74) *Attorney, Agent, or Firm*—Bacon & Thomas PLLC

(57) ABSTRACT

A method and device for thermal drying of a solid product in small pieces utilizing a first contact element and a second contact element between which a layer of the solid product can be brought into contact. The first contact element and, opposed thereto, the second contact element, are arranged so that at least one contact element is heated comprising a heat source forming part and at least one of the contact elements is gas permeable.

11 Claims, 2 Drawing Sheets

METHOD AND DEVICE FOR THERMAL DRYING OF A SOLID PRODUCT IN SMALL PIECES

BACKGROUND OF THE INVENTION

1. Field of the Invention

This invention relates to a method for thermal drying of a solid product in small pieces, whereby a layer of the product in small pieces is brought between a first gas permeable conveyor and a second gas permeable conveyor which both are in contact with the layer which is heated by supplying hot air.

2. Related Art

The invention particularly relates to a method for drying food products such as meals, vegetables, meat or fish, pharmaceutical products, minerals and so on, as far as they are in small pieces and preferably are somewhat deformable These products can be cut into pieces beforehand, but they can also naturally have the shape of small pieces, such as, for example, peas.

In known methods for thermal drying, the so-called conveyor drying, a stream of rather hot air is supplied over the products on a conveyor. These known methods, however, are relatively slow, whereas the applied high temperatures exert a disadvantageous influence upon the quality of the products.

A method of this kind is disclosed in DE-C-508.308. According to this method, plant materials are fed in a relatively thick layer between two endless perforated conveyors and heated by means of hot air. Hot air may be sucked from one side to the other along the layer. No pressure is exerted by the conveyors.

Another method of this kind, but for drying a filter cake, is disclosed in EP-A-0.651.218. A suspension is fed to an endless perforated conveyor. After filtering, the filter cake is dried by contact with heating elements inside a chamber heated by a gas. In one form the of embodiment, a pressure is exerted on the filter cake by perforated boxes provided with a supplemental heating element inside, which boxes do not move with the conveyor. In other embodiments the filter cake is brought between two perforated conveyors, but then no pressure is exerted. The temperature of the heating gas is as high as possible.

Although thermal drying always is preferred in respect to freeze-drying, as it is cheaper, it, anyhow, requires a lot of energy and has a low thermal efficiency.

SUMMARY OF THE INVENTION

The invention aims at a method for thermal drying of a product in small pieces, whereby these and other disadvantages are excluded and which is relatively fast and economical providing dried products of a good quality.

According to the invention, this aim is achieved by the fact that a layer with a thickness of 15 mm at the most is brought between the conveyors, a pressure between 1 g/cm$^2$ and 36 g/cm$^2$ is exerted onto the layer and the hot air has a temperature below 70° C.

Preferably, the small pieces are brought in a single layer between the two conveyors.

In a particular form of the embodiment, the drying by means of heat and pressure is exerted by the conveyors is preceded by a freezing of the small pieces.

The invention also relates to a device which is particularly suitable for the application of the method according to one of the preceding embodiments.

The invention thus relates to a device for the thermal drying of a product in small pieces, comprising two gas-permeable conveyors situated one above the other, between which a layer of small pieces can be brought into contact with these two conveyors, and further comprising means for creating a stream of hot air over the layer, characterized in that it contains means for exerting a pressure on the layer by the intermediary of at least one of the conveyors, and a freezing device preceding the conveyors.

The device may comprise means for bringing the small pieces in a single layer onto one of the conveyors.

BRIEF DESCRIPTION OF THE DRAWINGS

With the intention of better showing the characteristics of the invention, hereafter, as an example without any limitative character, preferred forms of embodiment of a method and device for thermal drying of a product in small pieces is described, with reference to the accompanying drawings, wherein.

BRIEF DESCRIPTION OF THE INVENTION

Figure 1:
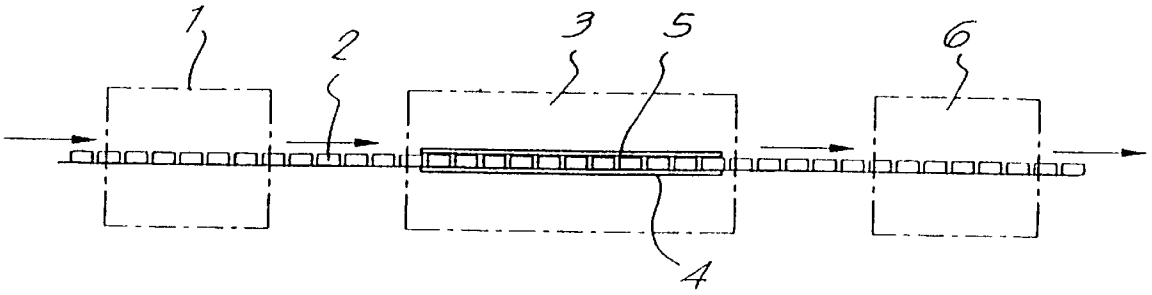
FIG. 1 shows a basic scheme illustrating the method for thermal drying according to the invention.

In order to dry a product in small pieces, for example, a vegetable which is cut into small pieces or naturally has the shape of small pieces, according to the invention, these small pieces first of all are deep-frozen in a deep-freezing device 1 to, for example, −4 to −8° C. This deep-freezing may be performed in the classical manners and mostly takes about twenty minutes.

This deep-freezing allows a considerable shortening of the total drying cycle and, thereby, an enhancement of the quality of the dried product.

By this deep-freezing, the structure of the product is almost not damaged, contrary to the actual freeze drying. If the products are vegetables, they need less blanching.

Of course it is also possible, instead of deep-freezing fresh products at the beginning of the drying cycle, to start with products already deep-frozen before, so that, for example, drying is also possible out of the harvest season of the products.

In a following and most important step, the small pieces are provided in a thin layer 2 in a contact dryer 3 between a lower contact element 4 and an upper contact element 5, in such a manner that the layer 2 is in contact with both contact elements 4 and 5.

Hereby, provisions must be made to maintain this contact even when the small pieces shrink as a result of drying.

If the small pieces are three-dimensional and, for example, blocks or discs of bulbous vegetables, a single layer 2 of small pieces is provided between the contact elements 4 and 5. These small pieces then will have a thickness of, for example, 2 to 5 mm.

If the product consists of, in first instance, two-dimensional pieces, for example, leaf products, either cut into pieces or not, then a layer 2 of several pieces on top of each other is formed, with a thickness which preferably is between 2 and 15 mm.

A light pressure is exerted upon the layer 2 in order to realize a good contact of the small pieces with the contact elements 4–5 even as shrinkage occurs. This pressure has to be limited in order not to cause an overheating or mechanical damage of the small pieces. This pressure lies between 1 g/cm$^2$ and 36 g/cm$^2$.

Both contact elements 4 and 5 are gas-permeable and, for example, provided with openings, such as perforations. Up to 80% of their surface may consist of openings.

Both contact elements 4 and 5 are also heated.

This heating may be performed directly, for example, by means of a built-in electric resistance, but preferably is performed indirectly by means of heated air which is supplied over or through the contact elements.

This air is somewhat heated, namely, up to a temperature which is below 70° C. and preferably below 60° C. and is mostly situated 15 to 30° C. above room temperature.

The small pieces themselves must not be heated above these temperatures and preferably are heated in such a manner that the temperature in their core does not rise above approximately 58° C.

The heating of the air can be performed electrically as well as by means of gas, oil or other fuels. The heat which is set free during deep-freezing may be recovered as well.

The speed of the air which does not only provide for the heating of the contact elements 4 and 5, but also carries off the humidity set free by the small pieces, also determines the speed of drying and is relatively large and larger than in normal conveyor drying, which is possible as the small pieces are retained between the contact elements 4 and 5 and cannot be blown off.

This air speed preferably is situated between 1 and 10 m/s and is, for example, approximately 3,8 m/s. The pressure of the air is regulated in such a manner that the wind speed is almost the same everywhere on the contact elements 4–5.

With such air speeds, the small pieces are kept a relatively short time, preferably less than 40 minutes and, for example, for an average time of approximately 15 minutes, between the contact elements 4 and 5 in the contact dryer 3.

In order to save space and costs, the retention of the small pieces in the contact dryer 3 can be stopped before they are completely dried, in fact as soon as the product is stable and does not shrink any further.

For the final drying, the small pieces are brought into an end dryer 6 where they are brought onto a plate or conveyor belt in a much thicker layer than the layer 2, and where a heated air stream is supplied over this layer.

Normally, the temperature of this air is higher than in the contact dryer 3, and the air speed is lower than in this contact dryer 3.

As a final dryer 6, a classic conveyor dryer can be used. This final drying has almost no influence upon the quality.

The dried end product is not only obtained rapidly and in a relatively cheap manner, but is of an excellent quality which approaches the taste obtained with freeze-drying, but without structural changes and with preservation of colours.

The drying may also take place without preceding deep-freezing and/or end drying, in the classical manner by means of hot air. It may, thus, take place exclusively by means of contact drying, this is the second step, as described heretofore. The drying time, however, will be longer, for example, up to 2 hours, which is still shorter than exclusively the classic drying with hot air, whereas the quality of the end product is significantly higher than the one obtained by means of this classic drying.

Figure 2:
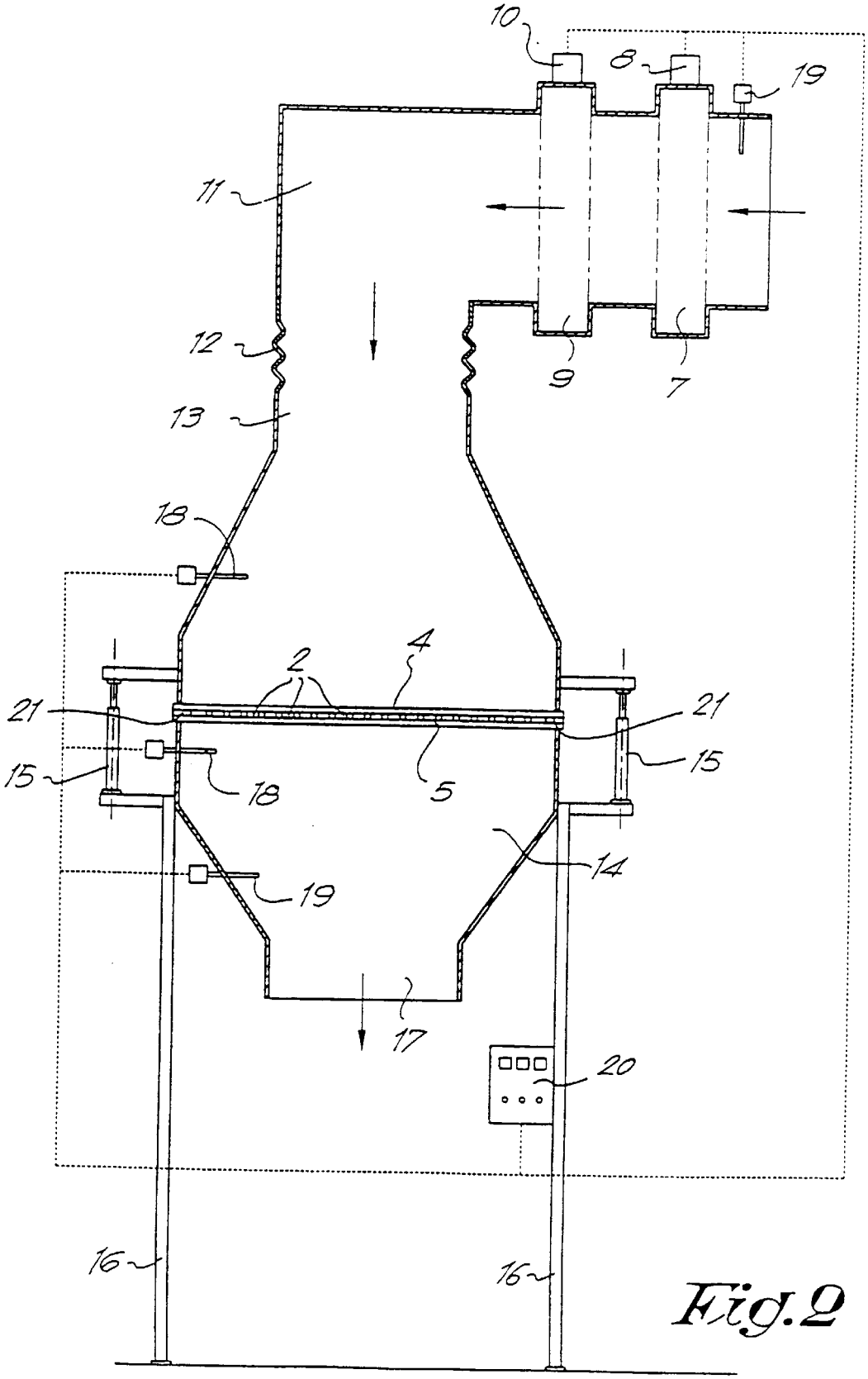
FIG. 2 schematically shows a cross-section of a practical form of embodiment of the device according to the invention of FIG. 1.

In FIG. 2, a practical embodiment of the device is represented with which drying according to the invention can be performed.

In the contact dryer 3, the means for heating the contact elements 4 and 5 comprise a fan 7 the speed of which is regulated by means of a frequency control and a heating unit 9 connected to the exit thereof which is controlled by a temperature-regulating unit and which forms a heat source.

This heating unit 9 may get the thermal energy out of electricity, gas, oil or other fuels.

The fan 7 and the heating unit 9 are provided in an air inlet channel 11 which is connected to the housing 27.

The housing 27 gives out to an air outlet channel 17.

The air outlet channel 17, together with the air inlet channel 11, forms part of the means for heating the contact elements 4 and 5 by means of hot air.

Temperature meters for measuring the temperature of the air stream are installed in the housing 27.

In the air inlet channel 11, in front of the fan 7, and in the housing 27, airspeed meters are provided.

The temperature meters and the airspeed meters are connected to an operating unit.

In order to facilitate and to accelerate the supply, the layer 2 can be provided beforehand between two mats which, during drying, have to be seen as forming part of the two contact elements 4 and 5, respectively.

By means of the fan 7 and the heating unit 9, air is sent through the contact elements 4 and 5, with the desired speed and at the desired temperature. These contact elements 4 and 5 and the layer 2 caught in between warm up, whereas the hot air carries off the humidity which has been set free out of the product, due to the heat.

Between the freezing device 1 and the contact dryer 3 a vibration device 22 is provided in order to supply a uniform layer 2 of small pieces of leafy vegetables or one single layer 2 of small pieces cut root- or bulbous vegetables to the contact dryer 3, and whereby between this contact dryer and the after-dryer 6 an endless transport conveyor 23 with a scraper 24 above is provided.

The freezing device 1 comprises a closed cooling chamber and an endless transport conveyor 25 placed therein for moving the product to be dried in small pieces through this cooling chamber. This may take place in a classic manner with a cooling circuit 26 or by means of liquid nitrogen.

The housing 27 consists of only one unit and the contact elements 4 and 5 are endless transport conveyors provided with openings, for example perforated conveyors, which are situated above each other and are driven separately by means of motors 28 or by means of a transmission together by one motor, in such a manner that the conveyors situated above each other between which the layer 2 is provided, move in the same sense of movement, away from the vibration device 22.

Instead of a perforated conveyor belt, the belt may be a woven belt or consist of a flexible grid.

One of the transport conveyors, for example, the uppermost, is adjustable in height by means of, for example, cylinders 29, in respect to a stand 16 which also carries the housing 27, in such a manner that the distance between the transport conveyors situated above each other can be adapted to the thickness of the layer 2 and in such a manner, that a light pressure may be exerted onto this layer 2.

Figure 3:
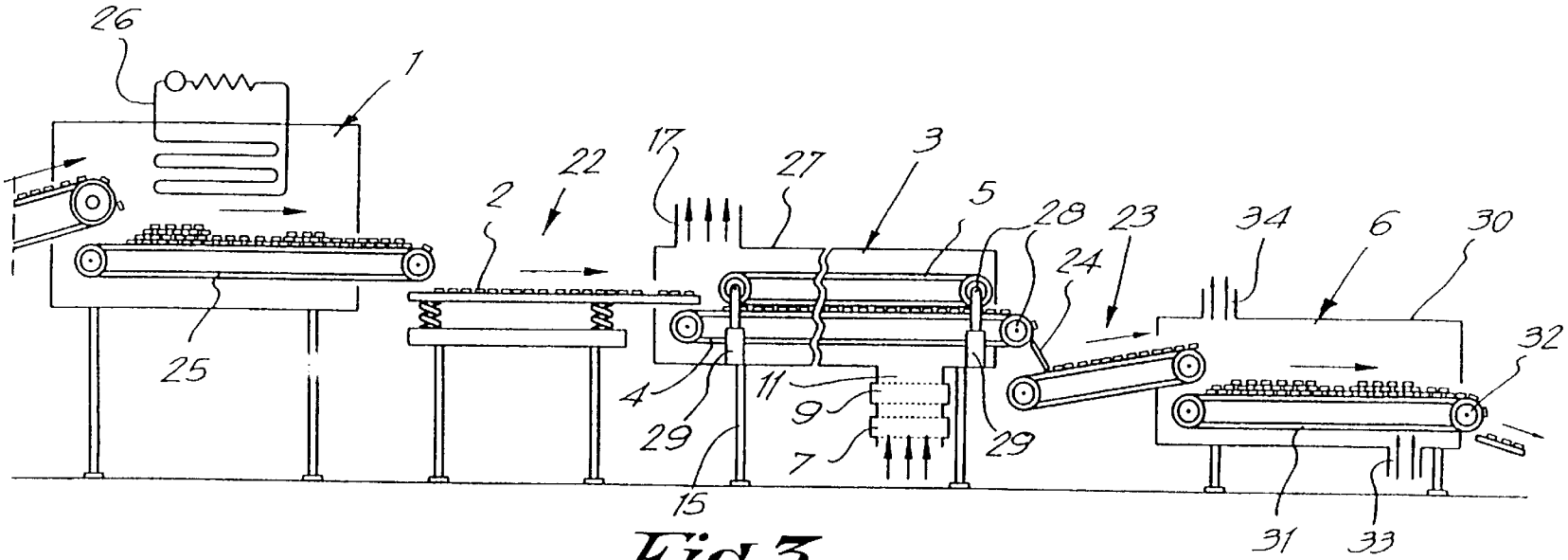
FIG. 3 schematically shows a cross-section analogous to the one of FIG. 1.

The air-inlet channel 11, in which the fan 7 and the heating unit 9 are situated, gives out in the housing 27, either above the upper transport conveyor forming the contact element 5, or inside this upper transport conveyor, or still beneath the lower transport conveyor forming the contact element 4, or inside this lower transport conveyor, as shown in FIG. 3.

In the first two cases, the air-outlet channel 17 is connected to the underside of the housing 27 and the hot air stream flows downwards from above. In the latter cases, the air-outlet channel 17 is connected upwards to the housing, and the air flows upwards from below, through the transport conveyors.

These transport conveyors are heated by the heated air which also takes along the humidity which is set free by the product.

The carried-off air may wholly or partially, for example between 40 and 60 vol. %, be re-used after drying and supplied at the inlet.

At the front, the housing 27 is provided with an opening for bringing in the layer 2 through the vibration device 22. At the back, the housing 27 is provided with an opening through which the transport conveyors protrude.

The aforementioned scraper 24 cooperates with the protruding extremity of the lower transport conveyor.

After scraping, the transport conveyors eventually might be cleaned or brushed off.

The end dryer 6 is a classic conveyor dryer with a closed housing 30 and a horizontal endless transport conveyor 31 which is driven by a motor 32.

To this housing 30 are also connecting an air-inlet channel 33 and an air-outlet channel 34, in an analogous manner as with the contact dryer 3. The major difference, however, consists in that the end dryer 6 does not comprise an upper transport conveyor, and in the working conditions.

The layer of small pieces which is brought onto the transport conveyor 31 by the aforementioned transport conveyor 23, is thicker than the layer 2, and the temperature of the air is higher, up to 75° C.

The end dryer 6 may comprise several transport conveyors which are provided behind each other or below each other and onto which the smal pieces successively drop.

Constructively, the end dryer 6 can be provided below the contact elements 4 and 5 in a common housing.

The continous drying, as described heretofore, allows a faster drying with a significantly better quality than the usual conveyor drying with hot air.

The present invention is in no way limited to the forms of embodiment described heretofore and represented in the figures, on the contrary may such method and device for thermal drying be realized in different variants without leaving the scope of the invention as claimed in the following claims.

The present invention is in no way limited to the forms of embodiment described heretofore and represented in the figures, on the contrary may such method and device for thermal drying be realized in different variants without leaving the scope of the invention.

What is claimed is:

1. A method for the thermal drying process of a solid product in small pieces, comprising: bringing a layer (2) of the product in small pieces between a first gas permeable conveyor (4) and a second gas permeable conveyor (5) with the first conveyor and the second conveyor in contact with the layer (2); heating the layer by supplying hot air at a temperature below 70° C., with the layer (2) having a maximum thickness of 15 mm; exposing the layer to a pressure applied by the contact of the layer between the first conveyor and the second conveyor, said pressure being in the range of 1 g/cm$^2$ to 36 g/cm$^2$.

2. The method according to claim 1, including transporting the small pieces in a single layer between the first conveyor and the second conveyor.

3. The method according to claim 1 or 2 including carrying out said heating step by supplying hot air at a temperature below 60° C.

4. The method according to claim 3, wherein the thermal drying process is preceded by freezing the small pieces.

5. The method according to claim 4 wherein the step of freezing the small pieces is performed at a temperature of −4° C. to −8° C.

6. A method according to claim 4, wherein the thermal process is a partial drying process including the step of following said drying by a second drying process such that the layer of small pieces is exposed to hot air from a second dryer while the layer is conveyed through the second dryer.

7. The device for the thermal drying of a product in small pieces, comprising two gas-permeable conveyors (4 and 5) situated one above the other, between which a layer (2) of small pieces can be brought into contact with the two gas-permeable conveyors (4 and 5); a heater device providing a stream of hot air over the layer (2) and being arranged to exert a pressure on the layer (2) by the intermediary of at least one of the conveyors (4 and 5); and a freezing device (1) preceding the conveyors (4 and 5).

8. The device according to claim 7 comprising an after-dryer (6) wherein the after dryer follows the device for the thermal drying.

9. The device according to claim 7 or 8 including a device arranged to bring the small pieces in a single layer onto at least one of the conveyors (4).

10. The device according to claim 9 comprising a vibration device (22) situated between said freezing device and said conveyors.

11. The device according to claim 7 or 8, wherein the conveyors (4 and 5) are installed in a housing (27) and said heater device comprises an air inlet channel (11) allowing air to enter the housing (27), a fan (7) disposed within the air inlet channel (11), an air outlet channel (17) connected to the housing (27), and a heating unit (9) located in the air inlet channel (11).

* * * * *